US006198404B1

(12) United States Patent
Campagnuolo et al.

(10) Patent No.: US 6,198,404 B1
(45) Date of Patent: Mar. 6, 2001

(54) SMALL WEAPON DECOY FOR MILITARY USE

(75) Inventors: Carl Campagnuolo, Potomac; James Chopack, Columbia; Jonathan Fine, Silver Spring; William Allman, Columbia, all of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/481,878

(22) Filed: Jan. 12, 2000

(51) Int. Cl.[7] ..... G08B 3/00

(52) U.S. Cl. ..... 340/691.2; 340/692; 340/384.3; 446/401; 446/405

(58) Field of Search ..... 340/691.2, 692, 340/693.8, 384.3, 324.1, 384.73, 384.71; 446/401, 405; 434/11, 16

(56) References Cited

U.S. PATENT DOCUMENTS

| | | | | |
|---|---|---|---|---|
| 4,175,353 | * | 11/1979 | Pickett | 46/227 |
| 4,365,439 | * | 12/1982 | Litynski | 46/227 |
| 5,195,920 | * | 3/1993 | Collier | 446/409 |
| 5,635,898 | * | 6/1997 | Walters et al. | 340/384.7 |
| 5,774,040 | * | 6/1998 | Lastoria | 340/384.3 |
| 5,855,004 | * | 12/1998 | Novosel et al. | 704/272 |

* cited by examiner

*Primary Examiner*—Jeffery A. Hofsass
*Assistant Examiner*—Daniel Prévil
(74) *Attorney, Agent, or Firm*—Paul S. Clohan, Jr.

(57) ABSTRACT

A small, portable, low cost, battery operated, radio-controlled decoy simulates the sound of small arms fire. The units may be deployed remotely in the field to distract and confuse defending forces when attacked by advancing or infiltrating forces.

6 Claims, 10 Drawing Sheets

SMALL WEAPON DECOY FOR MILITARY USE

The purpose of this invention is to bring forth a small, portable, low cost, battery operated radio-controlled decoy that simulates the sound of small arms fire. This would distract and confuse defending forces when attacked by advancing or infiltrating forces, such as Special Forces, Scouts Units and others. The decoy system can also be used to divert enemy soldiers that are in pursuit of units that have infiltrated their territory.

A simple scenario will indicate the tactical application: assume that a Scout Unit or a Special Forces unit has entered enemy territory, and suddenly they are discovered and are pursued by the enemy forces. As they retreat, they activate their radio transmitter decoys, which they have placed around the enemy camp earlier. The decoys are set up to transmit sounds that simulate an M16 or a machine gun. Now the enemy, hearing the sounds of many guns firing from many directions, believes that they are being attacked by a large force and returns fire in the directions of the decoys. The Scouts or Special Forces then have enough time to retreat.

The decoy operates by means of digitized sound signals which are stored in a computer memory such as an EPROM (erasable programmable read only memory) or EEPROM (electrically erasable programmable read only memory). The sounds corresponds to sounds made by standard military issue weapons such as the M16 rifle or the SAW or M60 machine gun. Since the sounds from a rifle or machine gun contain mostly high frequencies they can be simulated effectively by small, transducer, i.e. low cost horns or dome tweeters that are commercially available.

The sound simulator is installed in a small box, which also incorporates a radio-controlled link. The radio control is coded to prevent unauthorized activation and to enable individual activation of a number of different sound simulator units each responsive to a unique code. Such a remote control radio link is available in the military arsenal, and is known as the Remote Activated Munitions System (RAMS). Remote control will enable friendly forces to deploy the decoy, move some distance away, and then activate the decoys as needed to confuse the enemy in pursuit. The decoy will be able to project sounds simulating rifles and machine guns for at least several hundred feet.

DETAILED DESCRIPTION

Figure 1:
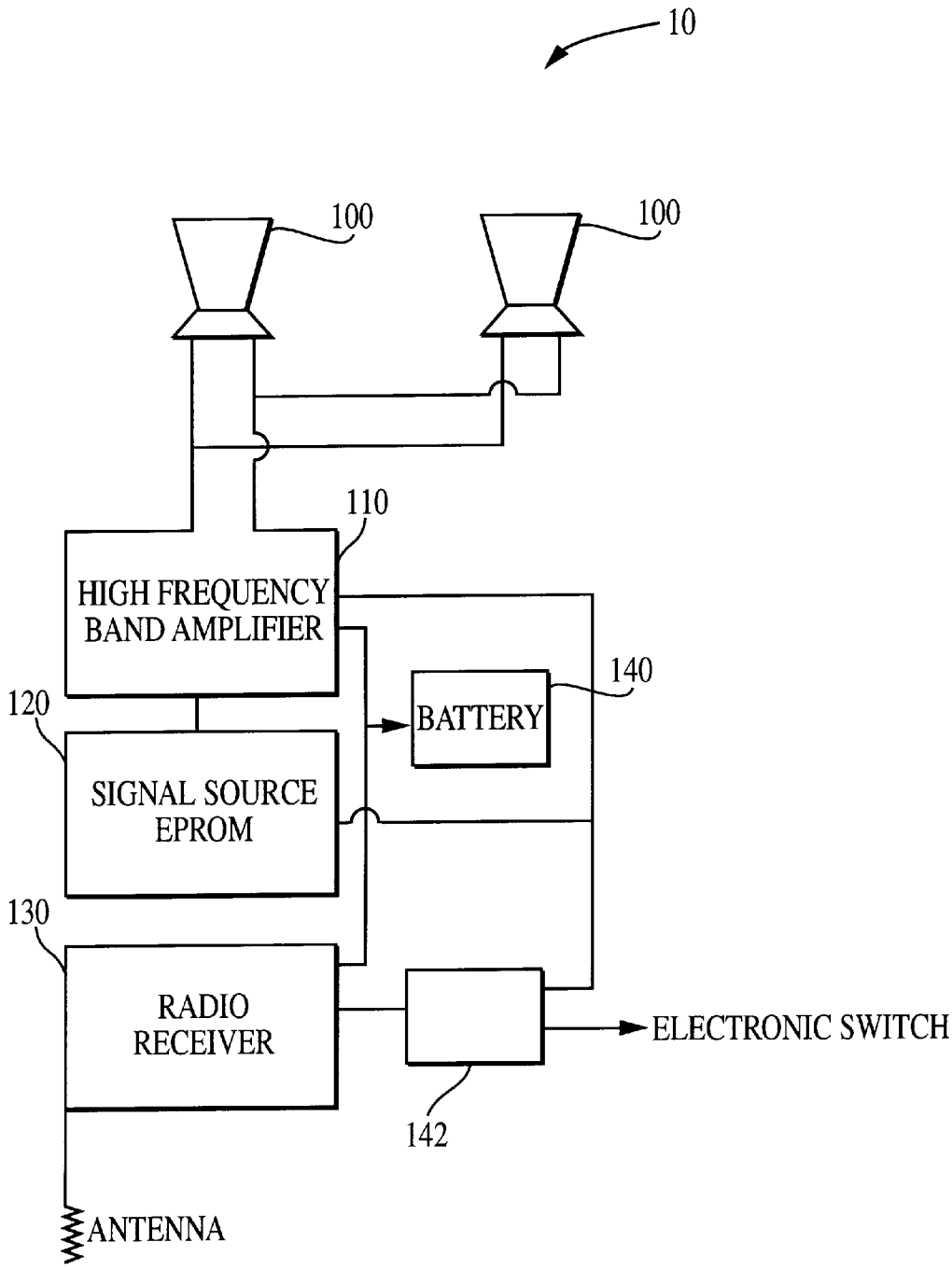
FIG. 1 shows a schematic of an embodiment of the invention.
Figure 2:
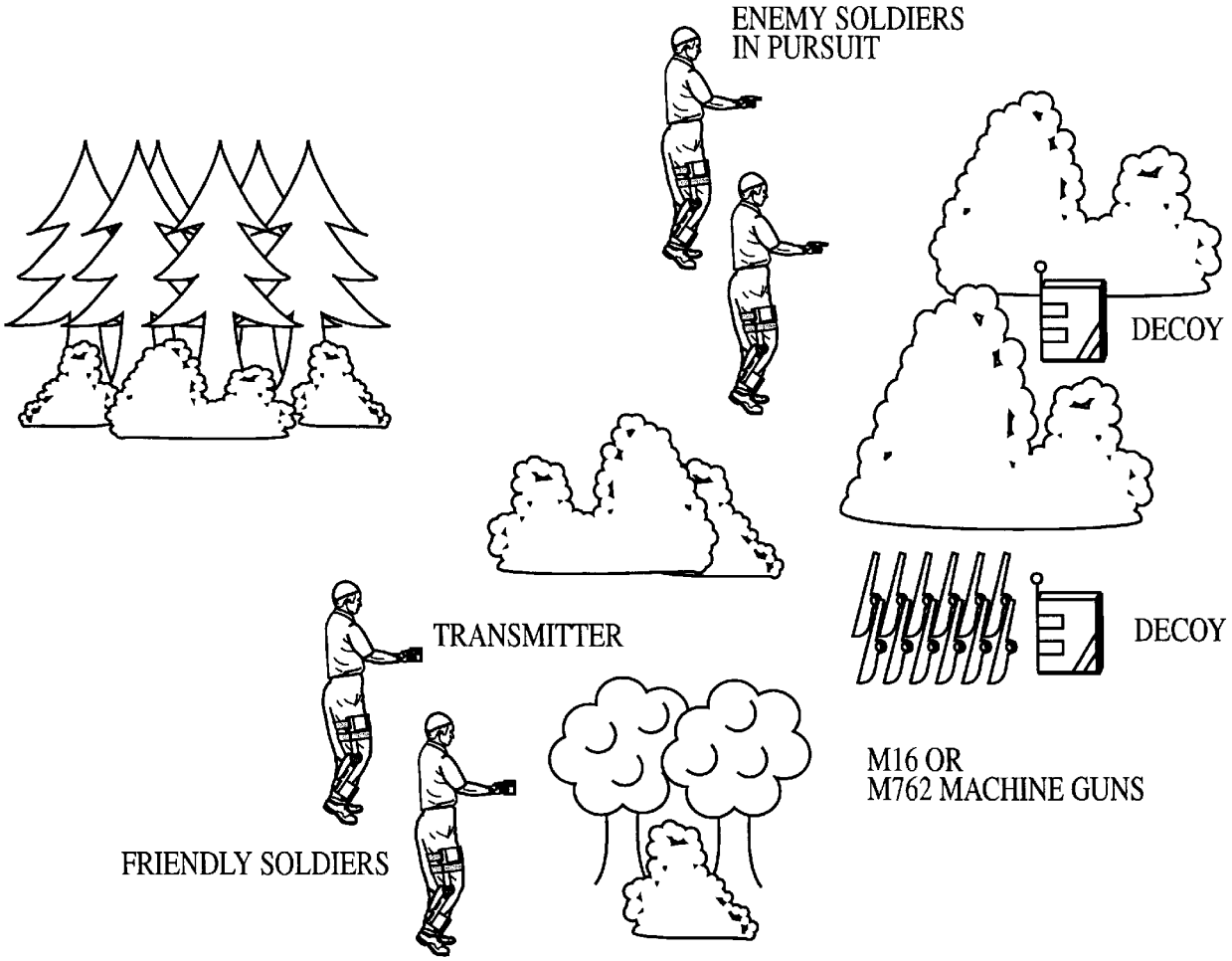
FIG. 2 shows a tactical scenario in which a decoy, hidden in the brush, attracts the enemy in pursuit, and allows friendly forces to escape.
Figure 3:
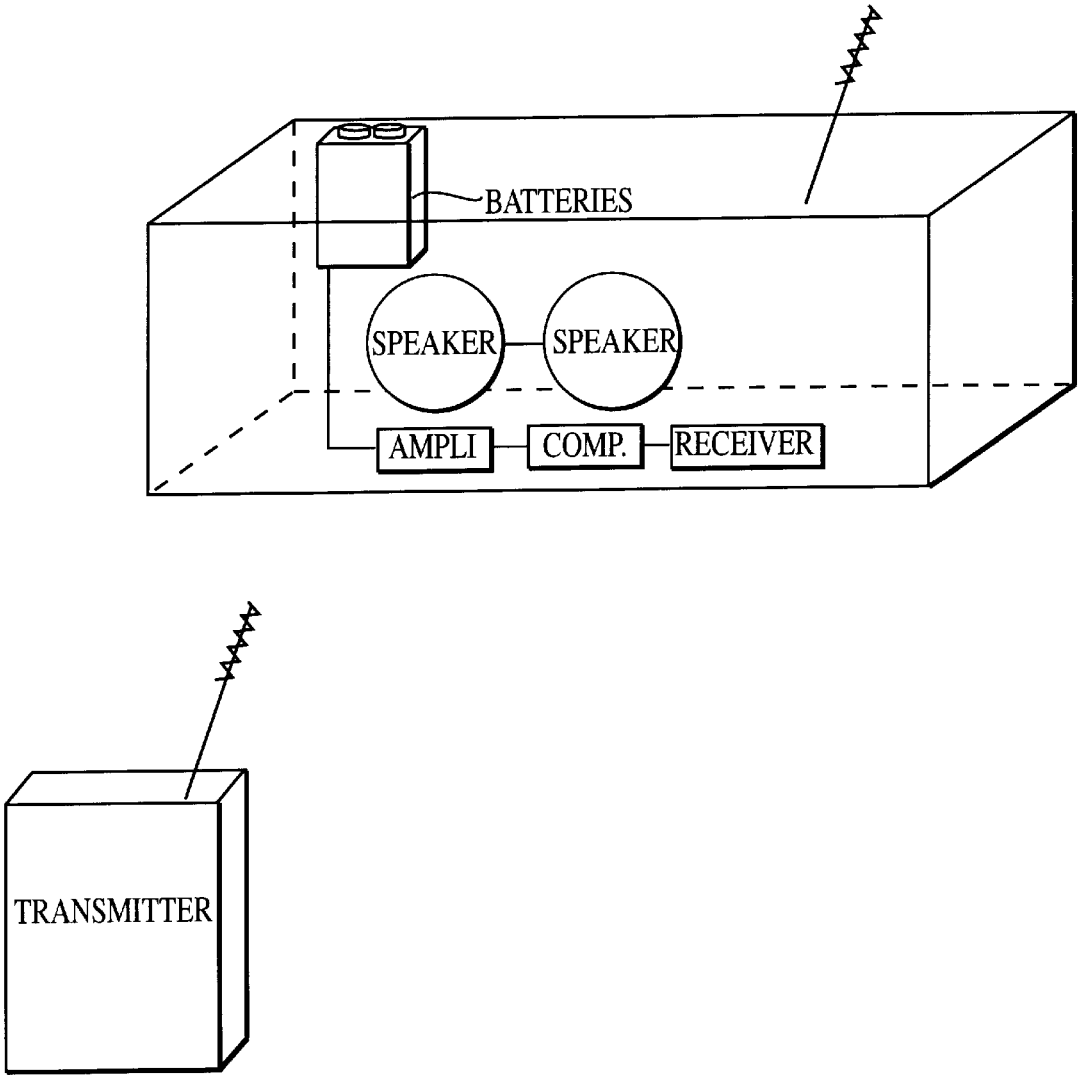
FIG. 3 is an illustration of a physical configuration of the decoy, showing some of the internal components.

With reference to FIG. 1, remote control sound simulator 10 includes high frequency horns (100) which emit a high frequency sound from a audio amplifier (110). The signal being amplified emanates from a signal source or EPROM (120), which is activated by a radio receiver (130) when it is stimulated by a transmitter (not shown).

Note that in FIG. 1, a battery 140 is used to power all system components at all times. When the radio receiver is activated by a transmitter (not shown) it turns on an electrical switch 142 (transistor board) which in turn activates the signal source 120, the high frequency amplifier 110 and the high frequency horns 110.

Example of Initializing System for Decoy

Figure 4:
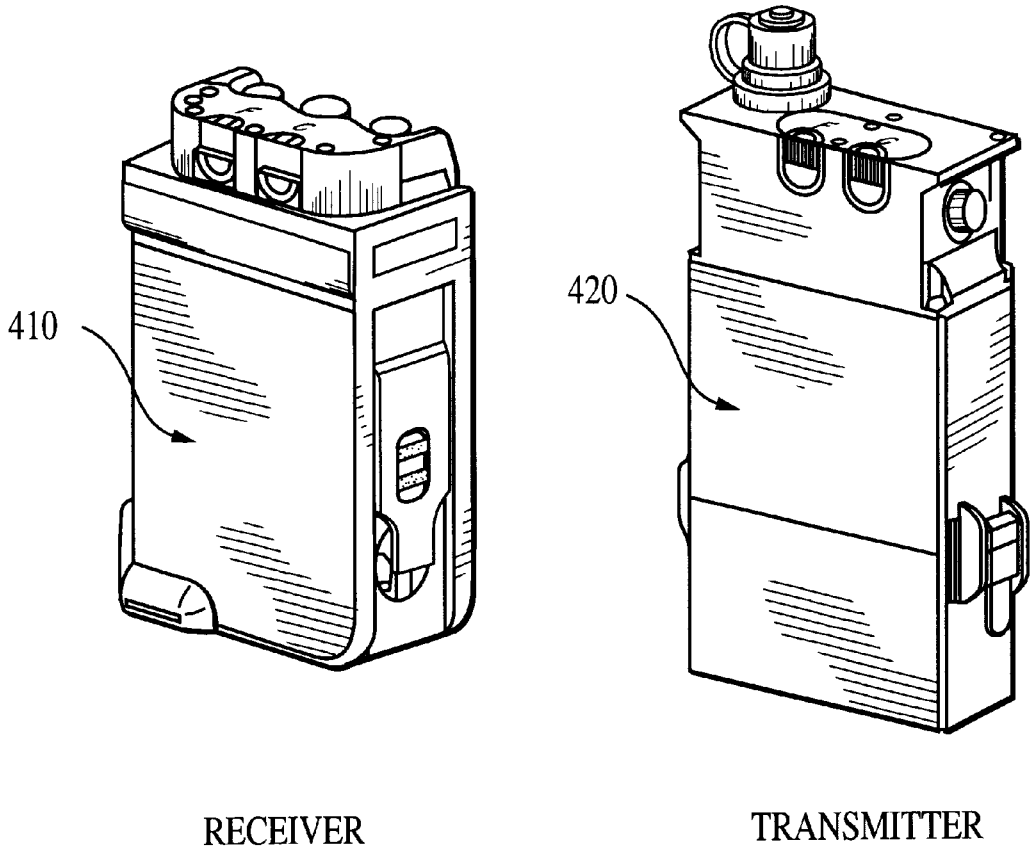
FIG. 4 shows a drawing of the Remote Activation Munition System (RAMS)

An example of a small, portable, battery operated radio transmitter and receiver suitable for use with the gun sound simulator and readily available in the military arsenal is shown in FIG. 4. The receiver 410 provides an electrical output to initiate the decoy upon receipt of a signal from the transmitter 420. The system in FIG. 4 is known as the Remote Activation Munition System (RAMS).

The Transmitter.

In a preferred embodiment, this control unit is capable of generating user-set special coded signals and radio transmitting them to any RAMS (or similar) receivers, which have been set by users to respond to these signals. With line of sight transmission, the transmitter, powered by its internal batteries, can actuate a matched receiver at a range of 1.2 miles. A RAMS antenna, (or a field expedient 10-foot piece of wire) must be attached to the transmitter's antenna post to properly facilitate transmission. The RAMS transmitter is powered by four user-installed standard 9-volt (transistor radio type) batteries.

The Receiver.

Preferably, the receiver will be like a RAMS receiver, i.e., a small, rectangular, handheld device which will function when it receives a specifically coded radio signal. The receiver may be set to respond to any of three common code signals, which can be transmitted by any RAM transmitter. Receivers can also be programmed by a specific transmitter to respond to one of four unique coded signals that can be generated only by that specific transmitter. Each Receiver is capable of functioning multiple decoys through up to 100 feet of WD-1/TT or other common type two-conductor signal wire. A suitable external antenna, such as a 10-foot piece of wire, must be attached and rigged as an antenna since the unit has no internal antenna and the best range is gained by the use of a well matched antenna. The receiver is turned on and its operational mode is set with its function selector switch. The function selector switch can be set to allow the receiver to be programmed to respond to common coded signals or a specific transmitter, perform an internal self-test, or perform an operational test. An arming tab on the side of the receiver starts a five-minute arming delay timer that does not allow the receiver to actually function until the five-minute arming delay has elapsed.

The receiver is reusable, and is equipped with a status indicator light and a sealable compartment for the single 9-volt battery used to power it. A lithium battery will allow the receiver to remain on duty, fully capable of performing for 15 days. The receiver will actuate the electrical output circuit when it receives the proper coded signal from the RAMS transmitter.

Decoy Circuit

Figure 5:
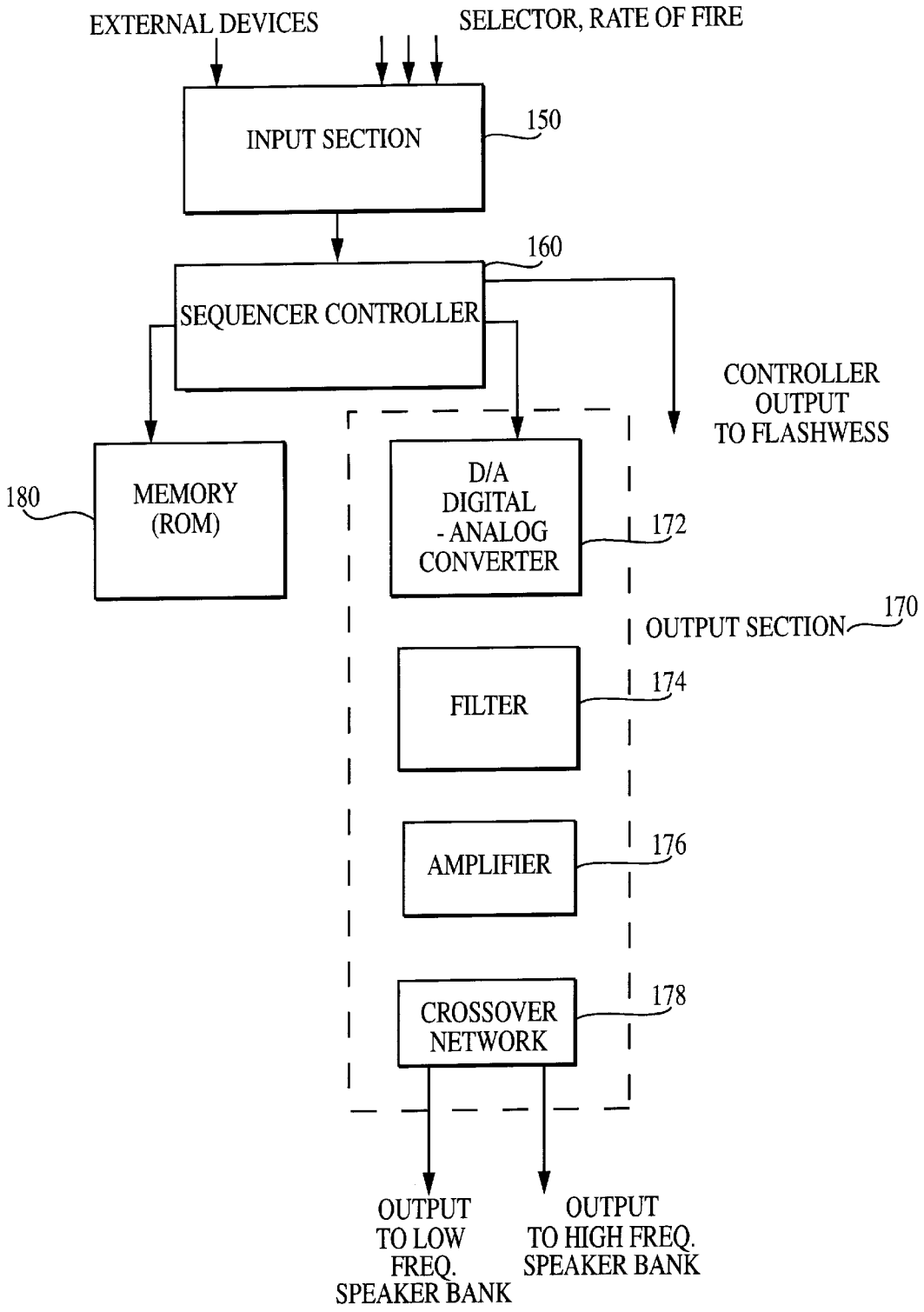
FIG. 5 shows a schematic of a control module.

The decoy box contains a control module as shown in FIG. 5, which consists of an input section 150, a memory 180, a sequence controller 160, and an output section 170.

The Input Section

The input section 150 contains several terminals that are optically isolated from the interior circuitry and can receive signals from remote stations, i.e. it can have an on-off switch activated directly by the RAMS transmitter or an electrical switch activated by the RAMS receiver. The decoy box could also be activated by a simple timer. The remote control signal is coded and carries information to select a weapon, and its firing mode (single-fire, low-rate-of fire, and high-rate-of-fire). For instance, it can select the sound of an M16 or that of an M60 machine gun and it can set the speed of fire; it can alternatively switch between the two weapons to further confuse the pursuing forces.

The Memory Section

The memory section 180 contains the digitized sound pulse information for the weapons that the decoy simulates. A sequencer section receives 160 instructions from the input section 150, activates the selected weapon and rate of fire, and directs the digitized gun sounds to the digital-to-analog (D/A) converter 172, the filter network 174, the amplifier section 176, crossover network 178 and finally to the sound transducers which may include both low and high frequency transducers. The digitized sound pulse information which is programmed into the EPROM is obtained from field recordings of the weapons to be simulated via either analog high-speed tape or digital recorder. In the laboratory the recording is played through a D/A converter, which digitizes the signal and outputs it to computer memory or floppy disk. By using a sound card and software such as Turtle Beach WAVE® for Windows, the sound may be processed by modifying it and playing it back through the amplifier and speaker system for aural evaluation.

Figure 6:
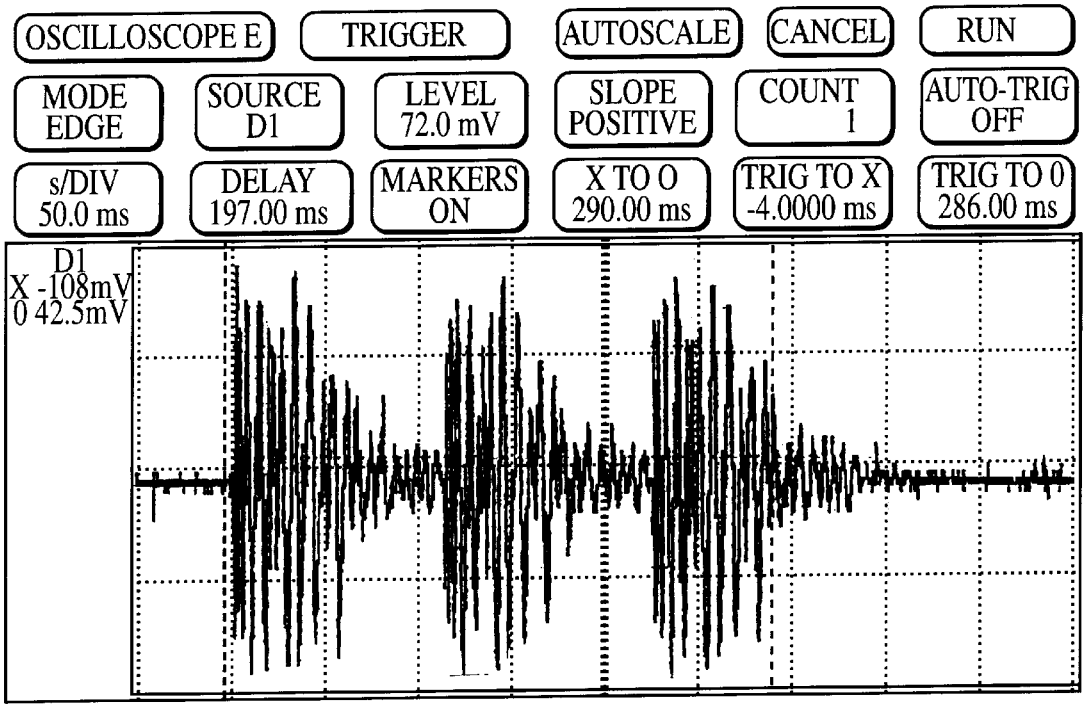
FIG. 6 shows a graph of the pulses that were selected for the 7.62 mm machine gun.

Two types of modifications are done. In the first one, the portion of the sound pulse to be stored in the decoy memory is selected. The digitized recorded sound contains many sound pulses, some having less noise than others. The best pulse, that is the pulse that provides the most realistic sound when played back through the amplifiers and speaker system, is chosen. The precise start and stop time of the pulse also are selected when playing back repeatedly through the system. The pulses that were selected for the 7.62 mm machine gun are shown in FIG. 6.

In the second modification, the sound pulse is cleaned to remove noise and further enhance the audio playback sound. The recording system is more susceptible to noise than the human ear, so it records noise along with the signal. The noise worsens the sound when it is played back through the system. Therefore, the pulse must be cleaned up electronically to remove the noise. The modified signal is shown for the 7.62 mm machine gun in FIG. 7. The same procedure is used for simulating the sound of an M16 rifle or any other weapon used for decoy.

Figure 7:
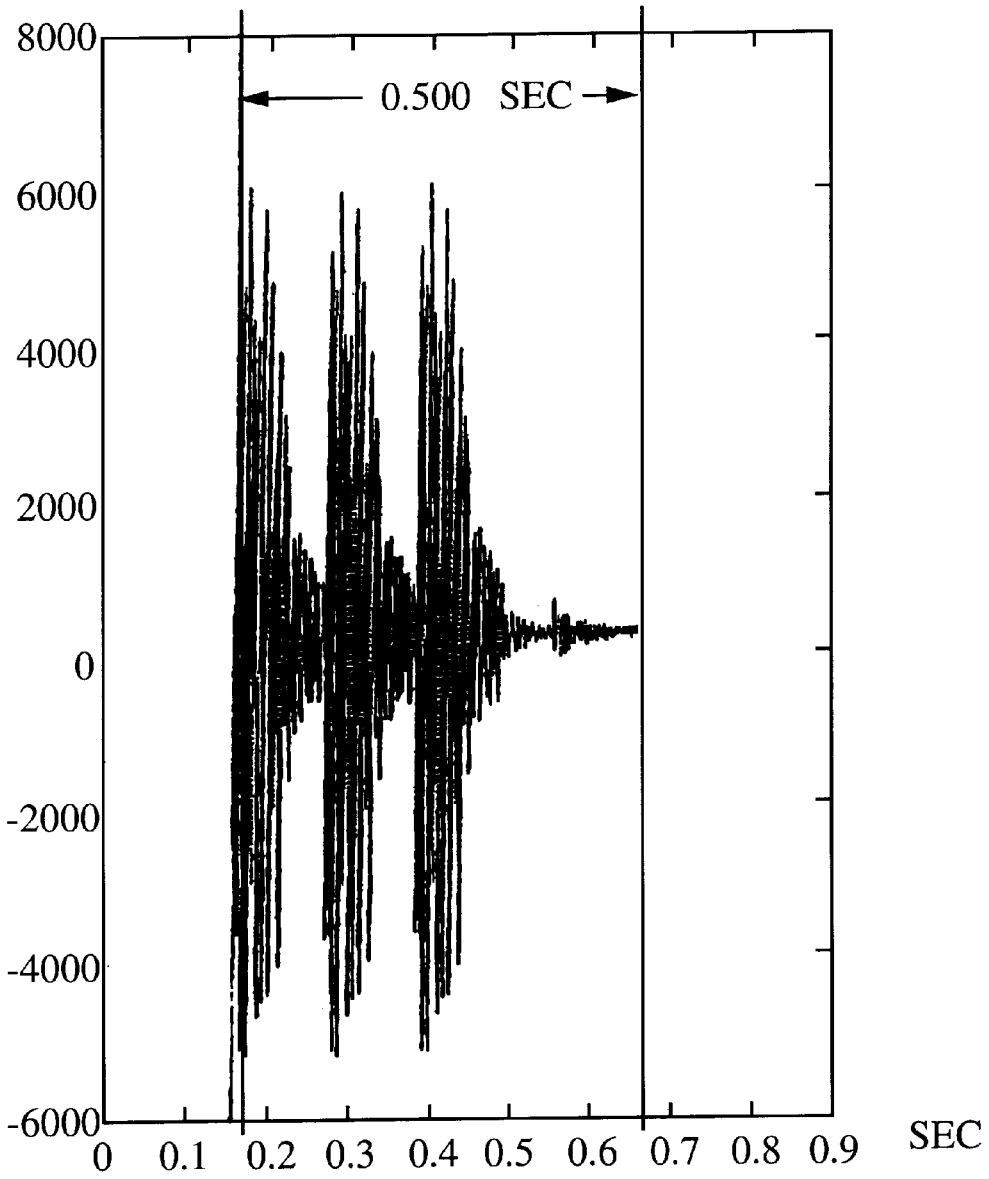
FIG. 7 shows a graph of the pulses shown in FIG. 6 after electronic processing to remove noise.

The modified pulse shown in FIG. 7 is stored permanently on an EPROM. The EPROM can be small and inexpensive since it will store only one pulse of each type of weapon used. The stored pulses can be played back at any desired repetition rate through the decoy speakers.

Simulator for Vehicle Gun Sound

Figure 8:
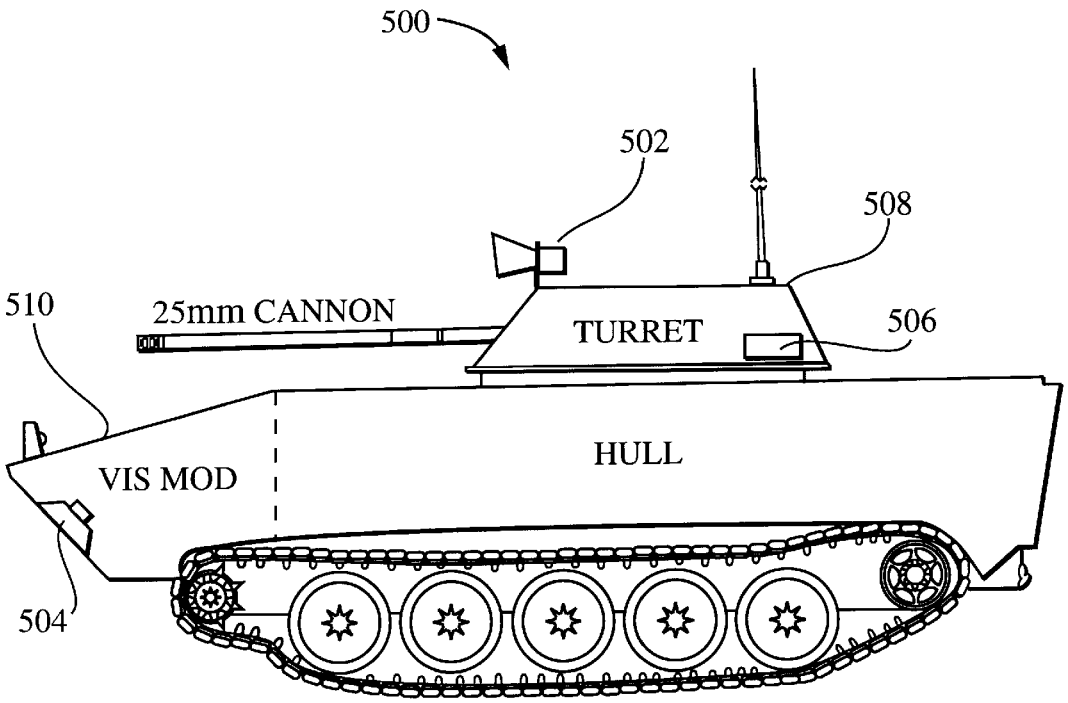
FIG. 8 shows a schematic of an OSV Russian troop carrier.

The concept, which has been described for the filed deployable decoy, can be extended to simulate other weapons, which can be used during forces-on-forces training. In training areas such as the U.S. Army's National Training Center, Fort Irwin, CA (NTC), training vehicles currently in use lack systems that can simulate the sound of real guns. A sound system that simulates that of a cannon for the OSV troop carrier would add reality to the battlefield training experience. The OSV is a Russian troop carrier used extensively by the opposing forces at NTC. A schematic of the OSV vehicle is shown in FIG. 8. The vehicle is furnished with a machine gun similar to the 7.62 mm gun and a cannon similar to the 15 mm cannon. The cannon can be fired in the single-shot mode, at a low-rate of fire of 100 rounds per minute, or at a high rate of fire of 200 rounds per minute. The machine gun has a single rate of fire of 700 rounds per minute.

The gun simulator is mounted on the vehicle 500 of FIG. 8 transducers such as. Acoustic horns 502 are mounted on the turret 508, and are powered by an audio amplifier 506 mounted inside the turret 508. Two woofers 504 are installed in the VISMOD compartment 510 and are connected to amplifier 506 in the turret 508. Woofers i.e., low frequency sound transducers 504 can be mounted on the hull of VISMOD 510 because the low frequency gun sounds are non directional. Control of all equipment takes place from the turret 508.

Figure 9:
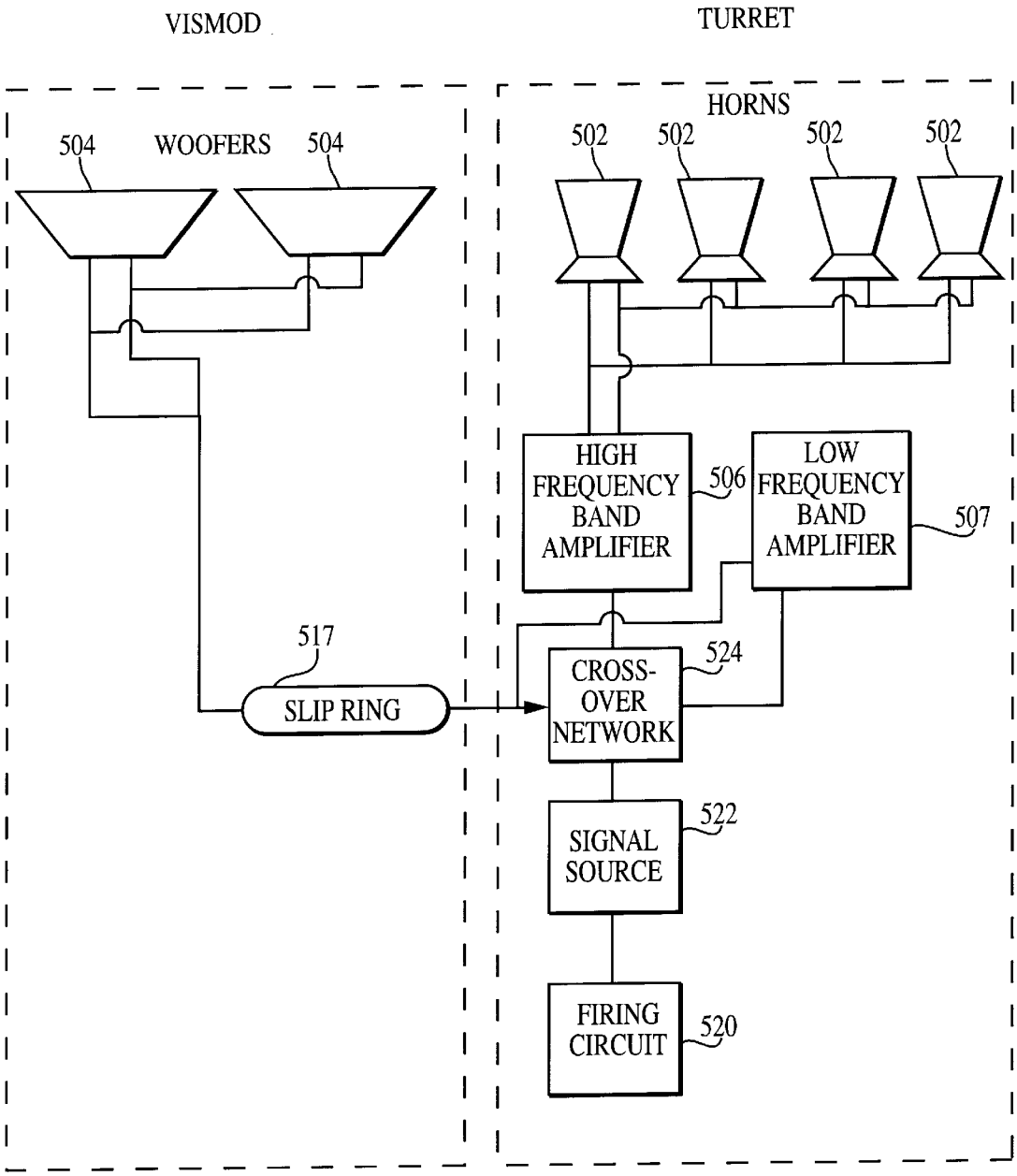
FIG. 9 shows that the low frequency output of a low frequency amplifier is conducted to the woofers through the slip rings in the turret.

FIG. 9 is a schematic of the components of the vehicle gun sound simulation system. The operator selects a weapon and firing rate and pushes the trigger button on the firing circuit 520. The signal source 522 then reproduces the corresponding audio signal. The signal then passes to a crossover network 524 that separates the sound signal into a high frequency band and a low frequency band. The high frequency band signal is directed to the input of a single-channel high frequency amplifier 506. The output of the amplifier goes to four horns 502 mounted outside the turret 508. Horns 502 broadcast the higher frequency portions of the signal. The low frequency band signal is directed to the input of single channel low frequency amplifier 507 mounted in the turret 508. The output goes to two woofer speakers 502 that are mounted in the VISMOD 510 and broadcast the lower frequency portions of the signal.

FIG. 9 shows that the low frequency output of a low frequency amplifier is conducted to the woofers through the slip ring 512 in the turret.

Figure 10:
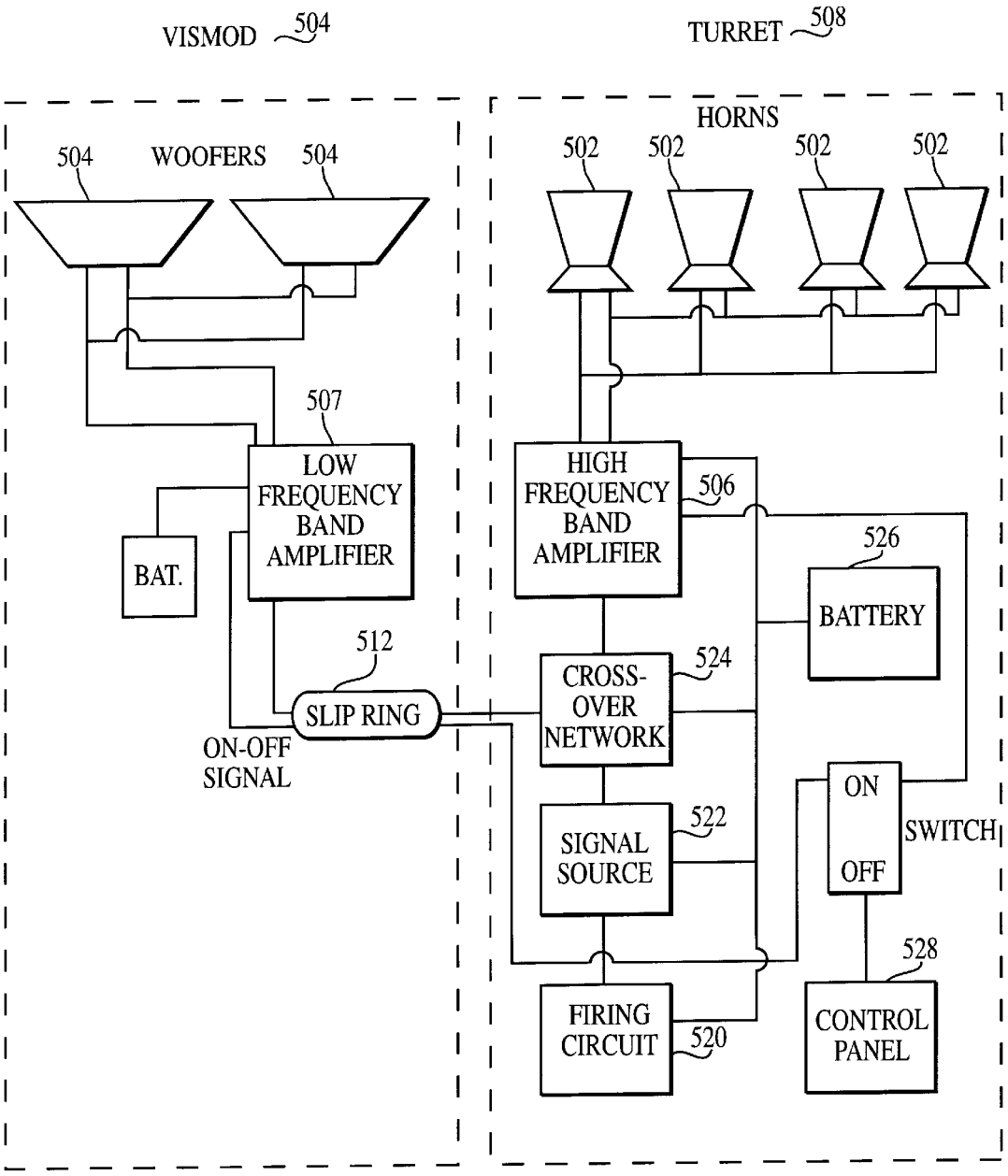
FIG. 10 shows vehicle batteries suitable for powering an embodiment of the present invention.

The system is powered by the batteries shown in FIG. 10. Battery 526 is mounted in the turret to power the amplifiers 506 and 507 and other equipment in the turret 508. The systems are turned on and off through a control panel 528. The control circuit for the system is the same as that used by the decoy and was described in FIG. 5.

The invention described in this application can be used to simulate the sound of virtually any type of gun or cannon. One can also simulate the sound of multiple guns firing at the same time (tandem mode) or firing randomly. The technology to accomplish all of the above is the same as that described by the decoys application.

Having thus shown and described what are at present considered to be preferred embodiments of the present invention, it should be noted that the same have been made by way of illustration and not limitation. Accordingly, all modifications, alterations and changes coming within the spirit and scope of the present invention are herein meant to be included.

We claim:

1. A radio-controlled decoy for simulating small arms fire sounds, comprising:

a sound transducer;

a memory for storing a digital audio representation of a small arms fire sound;

a sequencer for repeating the digital audio representation a predetermined number of times;

an analog to digital converter for converting the digital audio representation to an analog signal;

an audio amplifier for amplifying the analog signal to a level sufficient to power the sound transducer;

a radio receiver for activating the decoy; and a battery for providing power to the decoy wherein the radio receiver activates the decoy in response to a user-set coded signal.

2. The radio-controlled decoy of claim 1 wherein the sequencer is adjustable to play back the small arms fire sound at different rates of repetition.

3. The radio-controlled decoy of claim 2 wherein the sequencer may be configured to play back the small arms fire sound in burst or single shot mode.

4. The radio-controlled decoy of claim 2 wherein the sequencer may be configured remotely to play back the small arms fire sound in burst or single shot mode.

5. The radio-controlled decoy of claim 4 wherein the decoy is remotely configurable to simulate small arms sounds in different firing modes.

6. A vehicle gun sound simulator for simulating the sounds of turret mounted guns, comprising:

a low frequency sound transducer mounted on the vehicle hull;

a high frequency sound transducer mounted on the turret;

a memory for storing a digital audio representation of a gun firing sound;

a sequencer for repeating the digital audio representation a predetermined number of times;

an analog to digital converter for converting the digital audio representation to an analog signal;

an audio amplifier for amplifying the analog signal to a level sufficient to power the sound transducers;

a firing circuit;

an operator control panel for controlling the vehicle gun sound simulator, mounted in the turret; and a battery for providing power to the vehicle gun sound simulator.

* * * * *